United States Patent [19]

Hansmann et al.

[11] Patent Number: 4,528,912

[45] Date of Patent: Jul. 16, 1985

[54] TRACK LEVELING METHOD

[76] Inventors: Johann Hansmann, Martinstr. 153, 3400 Klosterneuburg, Austria; Frederick Fawcett, 22 Gypsy La., Hunton Bridge, Kings Langley WD4 8PR (Hertfordshire), England

[21] Appl. No.: 464,910

[22] Filed: Feb. 8, 1983

[30] Foreign Application Priority Data

Feb. 9, 1982 [AT] Austria ..... 490/82

[51] Int. Cl.[3] ..... E01B 29/04; E01B 27/02

[52] U.S. Cl. ..... 104/7 R; 104/11; 104/12

[58] Field of Search ..... 104/7 R, 7 B, 12, 11

[56] References Cited

U.S. PATENT DOCUMENTS

| | | | |
|---|---|---|---|
| 3,552,319 | 1/1971 | Plasser et al. | 104/8 |
| 3,799,058 | 3/1974 | Plasser et al. | 104/7 R |
| 3,919,943 | 11/1975 | Plasser et al. | 104/7 R |
| 3,949,678 | 4/1976 | Theurer | 104/7 R X |

FOREIGN PATENT DOCUMENTS

| | | |
|---|---|---|
| 188740 | 2/1957 | Austria . |
| 811956 | 8/1951 | Fed. Rep. of Germany . |
| 434096 | 5/1934 | United Kingdom . |
| 2021180 | 11/1979 | United Kingdom . |

*Primary Examiner*—Randolph A. Reese
*Assistant Examiner*—David F. Hubbuch

[57] ABSTRACT

In a method for automatically leveling a track comprised of two rails fastened to a succession of ties supported on a ballast bed to establish a desired track level, wherein successive track sections including a respective one of the ties are consecutively raised, additional track bed material is blown under each one of the raised ties to fill a gap between the ballast bed and each raised tie, and the raised track sections are lowered after the additional track bed material has been blown under the raised ties, the steps of measuring the existing track level at each tie to be raised and obtaining a corresponding parameter, establishing the difference between the parameter corresponding to the existing track level and a parameter corresponding to the desired track level, raising each successive track section above the desired track level, and controlling the amount of the additional track bed material blown under each raised tie at a point of intersection between the tie and a respective one of the rails in proportion to the established difference between the parameters corresponding to the existing and desired track levels.

4 Claims, 4 Drawing Figures

TRACK LEVELING METHOD

Figure 1:
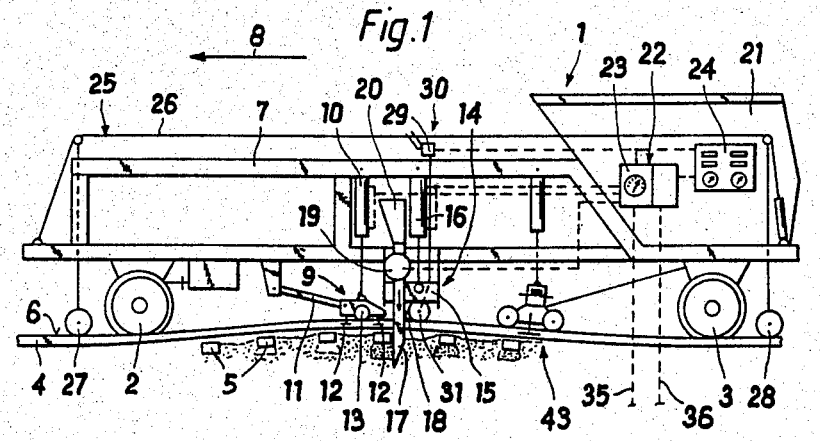

The present invention relates to a method for automatically leveling a track comprised of two rails fastened to a succession of ties supported on a ballast bed to establish a desired track level, wherein successive track sections including a respective tie are consecutively raised, additional track bed material, such as ballast, gravel or the like, is blown under each raised tie to fill a gap between the ballast bed and each raised tie, and the raised track sections are lowered after the additional track bed material has been blown under the raised ties. Such automatic track leveling is carried out by mobile track leveling machines well known to those skilled in the art.

German Pat. No. 811,956, of Aug. 23, 1951, discloses a method for filling particulate track bed material under individual ties with a portable pneumatic tool for blowing the particulate track bed material into the gap below a lifted track, the tool carrying a storage container subdivided by a horizontal sieve through which classified material falls to a slightly inclined container bottom. Vertical vibrations imparted to the tool direct this track bed material from the inclined container bottom through an annular funnel defined by the tool and an air nozzle coaxially arranged therein. Apart from the fact that the use of this portable hand tool requires extensive and time-consuming preparatory work, such as the erection and operation of a track lifting system for raising the track to the desired level, the relatively narrow annular funnel feeding the particulate track bed material into the tool makes it necessary to limit this material to relatively small particle sizes and since the material is fed through the annular funnel by vibration of the tool, the movement of the material is slow and the operation accordingly very time-consuming. Furthermore, the operator has no control over feeding an amount of track bed material sufficient to fill the gap between the track bed and the lifted track completely. Therefore, there is no assurance that the ties will have the desired level after the correction work has been completed. If an excessive amount of material is fed because the air blast is not switched off in time, the narrow passages within the tool will be jammed.

UK patent application No. 2,021,180, published Nov. 28, 1979, discloses a method of blowing ballast under raised ties with a mobile machine having a track lifting device and a pneumatic arrangement for introducing additional ballast into the gap under the lifted track. In this method, the additional ballast is carried by a vibratory conveyor from a storage container to a pipe arranged to receive ballast from the storage container and to be immersed in the track bed alongside a longitudinal edge of a respective track tie, the pipe having a tapered end for ready penetration into the track bed and a flattened side defining an outlet for the ballast facing the longitudinal tie edge. A vibratory feed table is placed below the storage container and an oblique chute delivers the ballast from the feed table into the pipe where it is moved to the outlet by a blast of compressed air. The outlet arrangement at one side of the pipe and the cross section thereof are designed to avoid jamming of the moving ballast in the lower, immersed portion of the pipe. However, no means is provided for properly metering the additional ballast in accordance with local requirements. Therefore, the delivery of ballast is continued until excess ballast emerges from the outlet above the tie and is deposited on the upper tie surface. Aside from the undesirability of this, a complete and uniform filling of the gap below the lifted tie is not assured because a pressure equilibrium between the ambient atmosphere and the compressed air pressure within the pipe may be created by the communication of the outlet with the atmosphere, causing only the purely dynamic effect of the compressed air jet to convey the ballast to the gap below the tie. Furthermore, in this arrangement, too, the particle size of the additional track bed material delivered into the gap is limited to about 20 to 22 mm.

It is the primary object of this invention to provide a track leveling method of the first-indicated type in which an exact metering of the blown-in additional track bed material is assured to establish the desired track level rapidly and completely while dependably eliminating jamming of the blown-in material.

The above and other objects are accomplished in the automatic track leveling method of the invention by measuring the existing track level at each tie to be raised and obtaining a corresponding parameter, establishing the difference between the parameter corresponding to the existing track level and an error parameter corresponding to the desired track level, raising each successive track section above the desired track level determined by the error parameter, limiting the amount of the additional track bed material blown under each raised tie at a point of intersection between the tie and a respective one of the rails to that required to attain a track level no higher than slightly above the desired track level under the control of the error parameter, and lowering the track tie to the desired level.

By raising the track sections to a measurable extent above the desired track level, it has for the first time been assured that a large enough gap is created for the necessary amount of additional track bed material proportional to the desired track level to be blown into the gap between the raised tie and the original track bed. Compared to the known track leveling methods substantially limited to situations where the track level error was relatively large so that there was ample room under the raised ties to receive the additional track bed material for support of the raised ties, the method of the present invention makes it possible to operate in track sections where the ties are only a little below the desired level since raising them above this desired level provides a gap of sufficient size to receive the additional track bed material metered to provide the tie support at the desired level. In this manner, the method can be used for continuous track leveling of an extended track section by blowing additional track bed material under each raised tie and uniformly compacting the ballast to provide an accurate desired track level along the entire section.

Furthermore, the automatic track leveling method of this invention is readily adapted for automation of the consecutive operational stages involved in the method so that monitoring of these stages, particularly as far as the end phase of the injection of the additional track bed material is concerned, and operating errors due thereto are avoided. All in all, the track leveling method of the invention substantially increases the efficiency of the operation and achieves greater precision in the track position correction.

Figure 2:
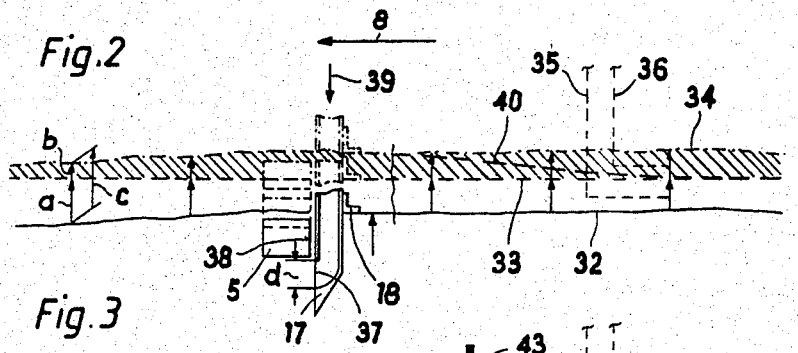
Figure 3:
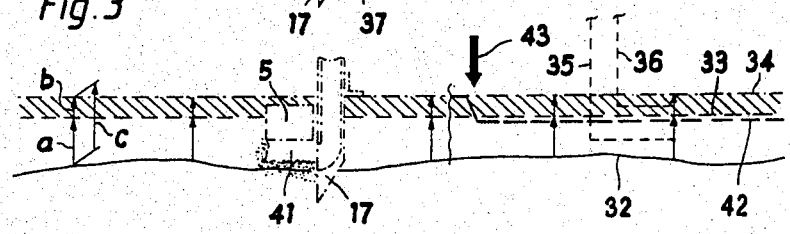
Figure 4:
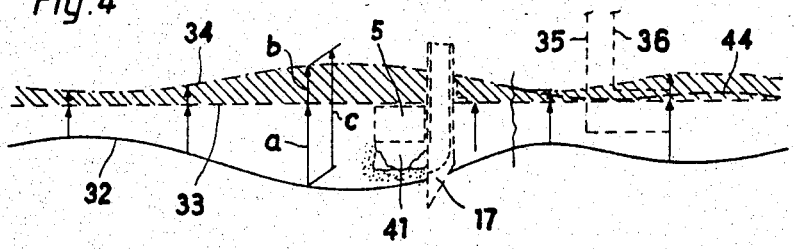

The above and other objects, advantages and features of the present invention will become more apparent from the following description of certain now preferred embodiments thereof, taken in conjunction with the accompanying generally schematic drawing illustrating a mobile track leveling machine capable of carrying out the automatic track leveling method of this invention and certain preferred embodiments of the method. In the drawing, FIG. 1 is a side elevational view of the mobile track leveling machine, FIG. 2 diagrammatically shows the level of a track section and the correction thereof in accordance with one embodiment of the method, FIG. 3 is a like view of a second embodiment of the track leveling method, and FIG. 4 is a like view of a third embodiment thereof.

Referring now to the drawing and first to FIG. 1, there is shown self-propelled track leveling machine 1 whose frame 7 is mounted on undercarriages 2, 3 for movement in an operating direction indicated by arrow 8 along track 6 comprised of two rails 4 fastened to a succession of ties 5 supported on a ballast bed.

Generally conventional track raising device 9 is linked to machine frame 7 by double-acting hydraulic lifting jack 10, on the one hand, and connecting rods 11, on the other hand, whose ends are linked by universal joints to a bracket at the underside of frame 7 and a carrier frame of device 9, respectively. The illustrated track raising device has pairs of flanged lifting rollers 12 mounted on the carrier frame of the device for subtending and gripping the rail heads of rails 4 at their gage and field sides, and pressure roller 13 mounted on the carrier frame for engagement with the running surface of the rail heads and exerting a vertical downward pressure thereon.

Pneumatic arrangement 14 for injecting additional track bed material, such as ballast, gravel or the like, under ties 5 at their points of intersection with rails 4 is associated with track raising device 9 and is mounted on machine frame 7 trailing device 9 in the operating direction. Pneumatic arrangement 14 comprises carrier part 15 guided vertically adjustably on machine frame 7 and double-acting hydraulic jack 16 links the carrier part of the pneumatic arrangement to the machine frame for vertical adjustment of the pneumatic arrangement. Two injection pipes 17 straddling each rail are supported on the carrier part for immersion into the track bed alongside a respective tie 5 at a respective point of intersection between the tie and rail 4. Each pipe carries a preferably vertically adjustable stop 18 for engagement with the running surface of respective rail 4. Additional track bed material is stored in storage container 20 mounted on machine frame 7, metering device 19 meters a predetermined amount of the additional track bed material from the storage container to each pipe 17 and compressed air is blown into the pipe in the direction of the indicated arrow to blow the material into a gap below the tie in a manner to be described more fully hereinafter.

Operator's cab 21 of machine 1 carries not only the usual machine drive arrangements but also central control device 22 including indicating instrument 23 for controlling and indicating the parameters corresponding to the measured and desired track levels as well as a separate indicating device 24, which are connected to the measuring, operating and drive means of the machine.

Illustrated track leveling machine 1 is also equipped with track level reference system 25 which includes reference line 26 constituted, for example, by a tensioned wire and associated with each rail 4. The front end of the reference line is supported on rail sensing element 27 in a section of the track which has not yet been leveled and the reference line rear end is supported on rail sensing element 28 in a leveled section of the track. Track level measuring device 30 including sensor 29 constituted, for example, by a rotary potentiometer 29 cooperates with the reference line to establish the parameters corresponding to the measured and desired track levels and generates control signals transmitted to control device 22 and indicating device 24, device 29, 30 being supported on rail sensing element 31 in the range of pneumatic arrangement 14. This track level measuring system, which controls track raising device 9 as well as metering device 19 delivering the amount of additional track bed material blown under each raised tie at a point of intersection between the tie and a respective rail, enables the difference between the measured and desired track levels to be established so that the required lifting stroke a may be determined for the desired track level. The track level measuring system continuously cooperates with the reference line as machine 1 advances in the operating direction so that it is possible continuously to establish the difference between the parameter corresponding to the measured track level and a parameter corresponding to the desired track level whereby lifting stroke b for temporarily raising the track section above the desired track level is monitored and controlled. The parameters established by track level measuring device 30 are transmitted to indicating device 24 in digital and/or analog form and the parameters corresponding to lifting stroke b raising the track section above the desired track level are indicated at indicating instrument 23 of control device 22.

In the track leveling method according to the invention, successive track sections including a respective tie 5 are consecutively raised, the existing track level is measured at each raised tie to be raised and a corresponding parameter is obtained, the difference between the parameter corresponding to the existing track level and a parameter corresponding to the desired track level is established, each successive track section is raised above the desired track level, an amount of additional track bed material controlled in proportion to the established difference between the parameters corresponding to the existing and desired track levels is blown under each raised tie at a point of intersection between the tie and a respective rail to fill a gap between the ballast bed and each raised tie, and the raised track sections are lowered after the additional track bed material has been blown under the raised ties. For the controlled metering of the amount of additional track bed material according to the method of this invention, the parameters established by track level measuring device 30 are used to control metering device 19. This control is based on the fact that this amount of additional track bed material is in direct proportion to lifting stroke a, i.e. the measured difference between the measured and desired track levels at each tie, as modified by a correction factor dependent on the type of additional track bed material used. The metering device is accordingly set manually by the operator of the machine according to readings on indicating device 24 or is automatically controlled by control device 22 transmitting a control signal to metering device 19 in response to the control signals transmitted to the control device by track level measuring device 30.

As more clearly shown in FIGS. 2–4, injection pipe 17 has a flattened end portion facing tie 5 and defining outlet 37 for the additional track bed material. As machine 1 advances in the direction of arrow 8, successive ties 5 are continuously raised step by step until the track level measured by device 30 exceeds the desired track level determined by reference line 26 (lifting stroke c), and the amount of additional track bed material proportioned to the desired track level (lifting stroke a) is subsequently blown under each successive tie step by step while pipe 17 is held by stop 18 fixed relative to the raised track section. The extent of the immersion of the pipe is determined by the setting of stop 18 so that outlet 37 is in registry with the gap under the raised tie. The successive ties are then lowered to the desired track level in response to the parameter corresponding thereto. This method results in a continuously proceeding leveling operation which leaves the track at the desired level and fixed in position on a uniformly compacted and dense track bed.

This method is also notable for its great adaptability to various track and ballast bed conditions as well as to different operational programs. One such embodiment of the method is illustrated in FIG. 2, wherein the parameters corresponding to the measured and desired track levels are established by reference line 26, each successive tie 5 is raised by the same amount above the desired track level, and the tie is then lowered, preferably under a vertical load, after the proportional amount of the additional track bed material has been blown in. In FIG. 2, line 32 indicates the original track level before correction. Broken line 33 indicates the desired corrected track level to be obtained after correction, as determined by the reference line of reference system 25 establishing parameter a corresponding to the lifting stroke involved in attaining the desired track level, i.e. distance a is the distance between track levels 32 and 33 as tie 5 is raised from the original to the desired track level. For reasons to be explained more fully hereinafter, the tie is raised above the desired track level by a predetermined parameter b measured by the reference system so that parameter c corresponding to the entire lifting stroke for the raised tie is constituted by the sum of the predetermined measured and desired track levels. In the embodiment of FIG. 2, parameter c is the same for all points of the track section being leveled. The track level determined by lifting stroke c is shown by chain-dotted line 34 and extends parallel to original track level 32. As schematically shown in FIGS. 1 and 2 by control circuit lines 35 and 36 connecting track raising device 9 to control device 22, the control device automatically controls the raising of the track by the indicated parameters. This embodiment of the track leveling method will be particularly useful if the original track level is relatively even and lies only a little below the desired track level. It can be automated with relatively simple controls without difficulty and in a manner generally well known to those skilled in the art of automatic track leveling. Since lifting stroke c is the same for each tie, the track raising device needs to be disconnected only at the end of the passage of machine 1 along a track section being corrected. The control signal producing the disconnection of the track raising device may be used for controlling the start of the injection of the additional track bed material under the raised ties.

Using machine 1 of FIG. 1, the track leveling operation according to FIG. 2 proceeds in the following manner:

The machine is advanced to the operating position shown in the drawing for blowing additional track bed material under raised tie 5. In this position, the flattened end portion of the pipe extends in the plane defined by adjacent longitudinal edge 38 of tie 5. Hydraulic jack 16 for the vertical adjustment of pneumatic arrangement 14 is now actuated by control device 22 to lower carrier part 15 along its vertical guides and to immerse the two pipes 17 straddling each rail 4 in the track bed until pipe outlets 37 are below tie 5 along their entire height d. The penetration of injection pipes 17 into the track bed may be facilitated if they are vibrated while being lowered. The immersion depth is controlled by stop 18 on the pipes when the stop engages the rail. This full immersion position of pipe 17 relative to tie 5 is indicated in full lines in FIG. 2.

In the next operating phase, control device 22 actuates track raising device 9 to raise the track while pressure is removed from the chambers of jack 16 to enable pneumatic arrangement 14 to rise with the track as stops 18 of pipe 17 engage the track rails. Since rail sensing element 31 runs on the track rails in the range of track raising device 9 and pneumatic arrangement 14, track level measuring device 30 is also raised with the track and measuring sensor 29 (a rotary potentiometer) cooperating with reference wire 26 of track level reference system 25 is accordingly adjusted. The measuring sensor emits control signals corresponding to the measured track level parameters and transmits the same continuously and simultaneously to control device 22 and indicating device 24. As soon as the track has reached the level indicated by broken line 33 and the broken-line showing of tie 5, indicating device 24 will show a differential measuring parameter a between original level 32 and desired track level 33. Simultaneously, control device 22 will adjust metering device 19 so that an amount of additional track bed material proportional to parameter a will be held ready for delivery to pipe 17.

Without interruption, the track is further raised to level 34 in the next operating phase, i.e. hydraulic jack 10 of track raising device 9 remains actuated until a predetermined gap is created under the raised tie, which is free of ballast. The reason for raising the track beyond the desired track level is to provide a gap of sufficient size under the tie to be able to receive with certainty all the additional track bed material proportioned to lifting stroke a and, also, to make certain that pipe outlet 37 will face the gap along its entire height d. It is, therefore, desirable that the sum a+b of the measured and desired track levels, i.e. total lifting stroke c by which the tie is raised, is at least equal to height d of pipe outlet 37. Parameter c accordingly should be so selected that both conditions are met for each tie 5 of the track, including ties at a particularly low original level as well as ties located almost at the desired level. In this manner, no jamming of the additional track bed material will occur at the pipe outlet, regardless of the position of individual ties. The control of lifting stroke c may be effected manually on the basis of the track level measurement indication at indicating instrument 23 or automatically by control signals transmitted by control device 22 to jack 10 of track raising device 9. The automatic control of track raising may proceed in either one of two ways. In one case, a predetermined value corresponding to a desired lifting stroke c may be stored in control device 22 as a comparison value. This comparison value is continuously compared in the control device with the value of the parameter corresponding to the track level being continuously measured by track level measuring device 30. As soon as the measured value corresponds to the comparison value, control device 22 transmits a control signal to jack 10 to stop its operation and block it in position so that gripping rollers 12 of track raising device 9 in cooperation with pressure roller 13 will hold the track at the raised level. In the other case (not shown in the drawing), injection pipe 17 may carry a switch signaling the position wherein pipe outlet 37 is free along its entire height d, and the corresponding control signal is transmitted to jack 10 to hold the raised track in position. In either case, tie 5 and pipe 17 are now in the position shown in chain-dotted lines in FIG. 2.

At the same time that raising of the track is discontinued, metering device 19 is actuated and the metered amount of the additional track bed material is delivered to pipe 17 while compressed air is applied thereto to blow the metered amount of additional track bed material through outlet 37 into the gap below tie 5. The additional track bed material injected by the two pipes straddling each rail will fill the gap under the tie at the intersection between the tie and rail uniformly. After the gap has been filled, control device 22 will actuate jack 16 to withdraw pipes 17 while simultaneously actuating double-acting jack 10 in reverse to exert a vertical load on the tie whereby the tie will be lowered to desired track level 33 while machine 1 advances in the direction of arrow 8, as is indicated by line 40 in FIG. 2.

FIG. 3 shows an embodiment of the track leveling method according to the invention in which lifting stroke b raising the track above the desired track level remains constant along the entire track section being leveled, and which has the advantage that all the operating phases may be fully automated. In this method, the level to which the track is temporarily raised beyond the desired level extends parallel to the reference line. Such a track leveling method has considerable advantages in devising the controls since the succession of raised ties is maintained at the measured track level and it is required merely to set the fixed parameter for this excess lift and to monitor the measured track level continuously to discontinue the track raising when this fixed parameter has been reached. The raising of the track by a constant amount also produces a uniform and very accurate operating result for long stretches of track.

In this method, the parameter corresponding to the excessive lift indicated on instrument 23 need only be compared with the parameter corresponding to excess lifting stroke b stored in control device 22. When the two parameters are equal to each other, drive 10 of track lifting device 9 is de-activated to stop raising the track further and to hold it at the raised position, and blowing is initiated. Ties 5 and blowing pipe 17 are shown in FIG. 3 in their vertical position above the desired track level. The excess lifting stroke b is so selected that, even under the most unfavorable operating conditions when the level of the raised tie is almost the same as that of the desired ultimate level, just about the entire outlet 37 of pipe 17 is open to gap 41 under the tie. In this embodiment of the method of the present invention, after the additional track bed material has been blown under the successive raised ties, the succession of raised ties is controllably lowered to track level 42 (shown in broken lines) below desired track level 33, level 42 corresponding to the settled ballast condition of the track. This settling phase is accomplished with dynamic track stabilizer 43 symbolically indicated by an arrow in FIG. 3 to show the vertical load exerted thereby on the track. This will produce not only a firmer bed for the rehabilitated track and, therefore, more stability for the leveled track but, it will also improve the accuracy of the levelling operation.

As is known, in dynamic track stabilization, the track is subjected simultaneously to a vertical load and to horizontal vibrations transversely to the track so that it is forced into the ballast and settles in the newly blown-in additional track bed material which is thereby uniformly and strongly compacted. The lowering of the track below desired track level 33, which is used for the proportioning the amount of the additional track bed material blown into gap 41, can be controlled accurately by track leveling reference system 25 so that the ultimate and lower level 42 corresponds exactly to a planned, settled track level of the rehabilitated track.

The embodiment of FIG. 4 is particularly useful when greatly varying level corrections must be effected. In this case, measured track level 34 to which the track is raised by lifting stroke b is proportional to parameter (lifting stroke) a corresponding to desired track level 33. This is done for the following reason: when tie 5 is positioned very low in relation to the desired track level, gap 41 under the tie raised to level 33 has a considerable height so that ballast from the two adjacent cribs tends to fall into the gap. This reduces the capacity of the gap to receive additional track bed material so that the complete introduction of the additional track bed material in proportion to parameter a is assured only if the tie is lifted to a level above desired track level 33 which is proportional to the original tie level below level 33. This excess lifting stroke also takes into account a long-standing experience in track leveling, i.e. that particularly low track points require special attention and work because, otherwise, the rehabilitated track will soon form low points again in these locations. Therefore, it is useful to retain such track points, which are found particularly at abutments between adjacent rail sections, slightly above desired track level 33 in the leveled condition because these points tend to settle more strongly during subsequent train traffic than other track points. This slightly higher ultimate level of the rehabilitated track is shown at 44 in FIG. 4.

What is claimed is:

1. In a method for automatically leveling a track comprised of two rails fastened to a succession of ties supported on a ballast bed to establish a desired track level, wherein successive track sections including a respective one of the ties are consecutively raised, additional track bed material is blown under each one of the raised ties to fill a gap between the ballast bed and each raised tie, and the raised track sections are lowered after the additional track bed material has been blown under the raised ties, the steps of (a) measuring the existing track level at each tie to be raised and obtaining a corresponding parameter, (b) establishing the difference between the parameter corresponding to the existing track level and an error parameter corresponding to the desired track level, (c) raising each successive track section above the desired track level determined by the error parameter, (d) limiting the amount of the additional track bed material blown under each raised tie at a point of intersection between the tie and a respective one of the rails to that required to attain a track level no higher than slightly above the desired track level under the control of the error parameter, and (e) lowering the track tie to the desired level.

2. In a track leveling method of claim 1, wherein the parameters are established by a reference line, each successive tie is raised the same distance above the desried track level, and the tie is then lowered after the limited amount of the additional track bed material has been blown in.

3. In the method of claim 2, wherein the tie is lowered under a vertical load.

4. In the method of claim 1, wherein the distance the successive ties are raised above the desired track level is proportional to the error parameter.

* * * * *

UNITED STATES PATENT AND TRADEMARK OFFICE

CERTIFICATE OF CORRECTION

PATENT NO. : 4,528,912

DATED : JULY 16, 1985

INVENTOR(S) : HANSMANN ET AL

It is certified that error appears in the above-identified patent and that said Letters Patent are hereby corrected as shown below:

Cover page, item [73] , insert Assignee's name and address: --Franz Plasser Bahnbaumaschinen-Industriegesellschaft m.b.H., Vienna, Austria.--

Signed and Sealed this

*Seventh* Day of *January 1986*

[SEAL]

*Attest:*

DONALD J. QUIGG

*Attesting Officer*

*Commissioner of Patents and Trademarks*